US012790066B2

(12) United States Patent
Lee

(10) Patent No.: US 12,790,066 B2
(45) Date of Patent: Nov. 10, 2026

(54) PACKAGING BOX

(71) Applicant: DORCO CO., LTD., Yongin-si (KR)

(72) Inventor: Hyeon Seok Lee, Seoul (KR)

(73) Assignee: Dorco Co., Ltd., Yongin-si (KR)

( * ) Notice: Subject to any disclaimer, the term of this patent is extended or adjusted under 35 U.S.C. 154(b) by 0 days.

(21) Appl. No.: 19/059,848

(22) Filed: Feb. 21, 2025

(65) Prior Publication Data

US 2025/0270002 A1 Aug. 28, 2025

(30) Foreign Application Priority Data

Feb. 27, 2024 (KR) ..... 10-2024-0028162

(51) Int. Cl.

| | |
|---|---|
| ***B65D 5/38*** | (2006.01) |
| ***B65D 5/10*** | (2006.01) |
| ***B65D 5/42*** | (2006.01) |
| ***B65D 5/50*** | (2006.01) |

(52) U.S. Cl.

CPC ..... *B65D 5/38* (2013.01); *B65D 5/10* (2013.01); *B65D 5/4208* (2013.01); *B65D 5/5038* (2013.01)

(58) Field of Classification Search

CPC ..... B65D 5/38; B65D 5/10; B65D 5/5038; B65D 5/4208; B65D 5/42; B65D 5/02

USPC ..... 206/349, 208, 209, 228, 273, 352, 784, 206/525

See application file for complete search history.

(56) References Cited

U.S. PATENT DOCUMENTS

| | | | | |
|---|---|---|---|---|
| 4,863,022 A * | 9/1989 | Czopor, Jr. | ..... | B65D 75/02 206/349 |
| 5,499,484 A * | 3/1996 | Herrin | ..... | B65D 5/103 53/458 |
| 2019/0023452 A1* | 1/2019 | Huffer | ..... | B23K 26/0846 |

FOREIGN PATENT DOCUMENTS

| | | | | |
|---|---|---|---|---|
| DE | 4135468 | * | 4/1993 | |
| DE | 4228026 | * | 3/1994 | |
| EP | 2397414 A1 | * | 12/2011 | ..... B65D 5/0227 |
| JP | H06-014022 U | | 2/1994 | |

(Continued)

OTHER PUBLICATIONS

Office Action received in Korean Application No. 10-2024-0028162 dated Jun. 19, 2025.

(Continued)

*Primary Examiner* — Rafael A Ortiz

(74) *Attorney, Agent, or Firm* — Knobbe, Martens, Olson & Bear, LLP

(57) ABSTRACT

A packaging box for a razor assembly is proposed. The packaging box may include a first packaging unit including a first accommodation space open at an upper portion, the first packaging unit including a coupling opening open in a lateral direction at least on one side of the longitudinal direction of the first accommodation space. The box may also include a second packaging unit including a second accommodation space configured to accommodate the first packaging unit, the second packaging unit including a wing configured to allow at least a portion thereof to enter a lateral side of the coupling opening in an in-position state, in which the first package unit received in the second accommodation space is not moved longitudinally. When the wing pivots about a first pivot axis parallel to the lateral direction, the first packaging unit moves in the longitudinal direction with respect to the second packaging unit.

18 Claims, 9 Drawing Sheets

(56) References Cited

FOREIGN PATENT DOCUMENTS

| | | | | |
|---|---|---|---|---|
| JP | 2011-093534 | A | 5/2011 | |
| JP | 2023-127188 | A | 9/2023 | |
| WO | WO-2006015117 | A1 * | 2/2006 | ..... B65D 5/503 |

OTHER PUBLICATIONS

Notice of Allowance dated Jan. 14, 2026, in Korean Patent Application No. 10-2024-0028162 in 3 pages.

* cited by examiner

PACKAGING BOX

CROSS REFERENCE TO RELATED APPLICATION

This patent application claims priority to Korean Patent Application No. 10-2024-0028162 filed on Feb. 27, 2024, which is incorporated herein by reference in its entirety.

BACKGROUND

Technical Field

The present disclosure relates to a packaging box, for example, for a razor assembly.

Description of Related Technology

Packaging boxes are used to transport or store products, and are being developed in various forms depending on the characteristics and shape of the products being packaged. These packaging boxes may generally be manufactured by processing, bending, or assembling a developed plate made of recyclable materials.

SUMMARY

One aspect is an eco-friendly packaging box that provides users with a new experience or fun when opened and allows the product inside to be easily taken out.

Another aspect is a packaging box, comprising: a first packaging unit comprising a first accommodation space that is open at an upper portion, the first packaging unit comprising a coupling opening open in a lateral direction perpendicular to a longitudinal direction at least on one side of the longitudinal direction of the first accommodation space; and a second packaging unit comprising a second accommodation space configured to accommodate the first packaging unit, the second packaging unit comprising a wing configured to allow at least a portion thereof to enter one lateral side of the coupling opening in an in-position state, in which the first package unit received in the second accommodation space is not moved longitudinally, wherein, when the wing pivots about a first pivot axis parallel to the lateral direction, the first packaging unit is configured to be moved in the longitudinal direction with respect to the second packaging unit.

As described above, according to an embodiment of the present disclosure, there is a benefit of providing an eco-friendly packaging box that provides users with a new experience or fun when opened and allows the product inside to be easily taken out.

DETAILED DESCRIPTION

Figure 1:
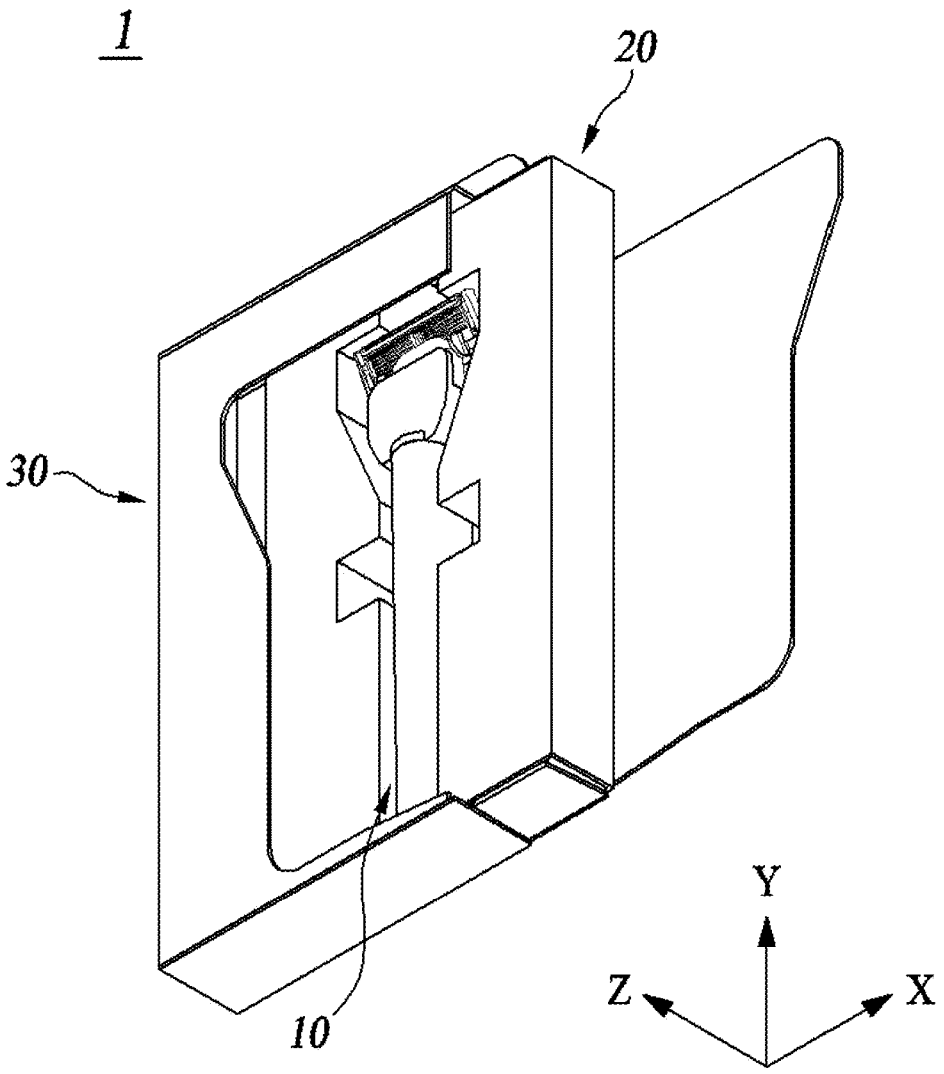
FIG. 1 is a perspective view of a packaging box according to an embodiment of the present disclosure when in an opened state.

Recently, there has been a demand for packaging boxes that go beyond simply packaging products and are designed to be convenient to open and allow the products inside to be easily taken out. In addition, packaging boxes that may provide users with a new experience or fun upon opening are in demand. Additionally, packaging boxes need to be manufactured in an eco-friendly manner in response to carbon reduction policies and environmental issues.

In particular, packaging boxes are often fixed in form by applying adhesive to the outer surface or attaching tape to the outer surface. In this connection, there is an issue that It is difficult to recycle packaging boxes due to adhesives or tapes, and the production time and manufacturing cost of the packaging box itself increases.

Hereinafter, some embodiments of the present disclosure will be described in detail with reference to the accompanying drawings. It is to be noted that in giving reference numerals to components of each of the accompanying drawings, the same components will be denoted by the same reference numerals even though they are illustrated in different drawings. Further, in describing exemplary embodiments of the present invention, well-known functions or constructions will not be described in detail since they may unnecessarily obscure the understanding of the present invention.

Terms 'first', 'second', i), ii), a), b), and the like, will be used in describing components according to embodiments of the present disclosure. These terms are only for distinguishing the components from other components, and the nature, sequence, order, or the like of the components are not limited by the terms. Throughout the present specification, unless explicitly described to the contrary, "including" or "comprising" any components will be understood to imply the inclusion of other elements rather than the exclusion of any other elements.

FIG. 1 is a perspective view of a packaging box 1 according to an embodiment of the present disclosure when in an opened state.

Figure 2:
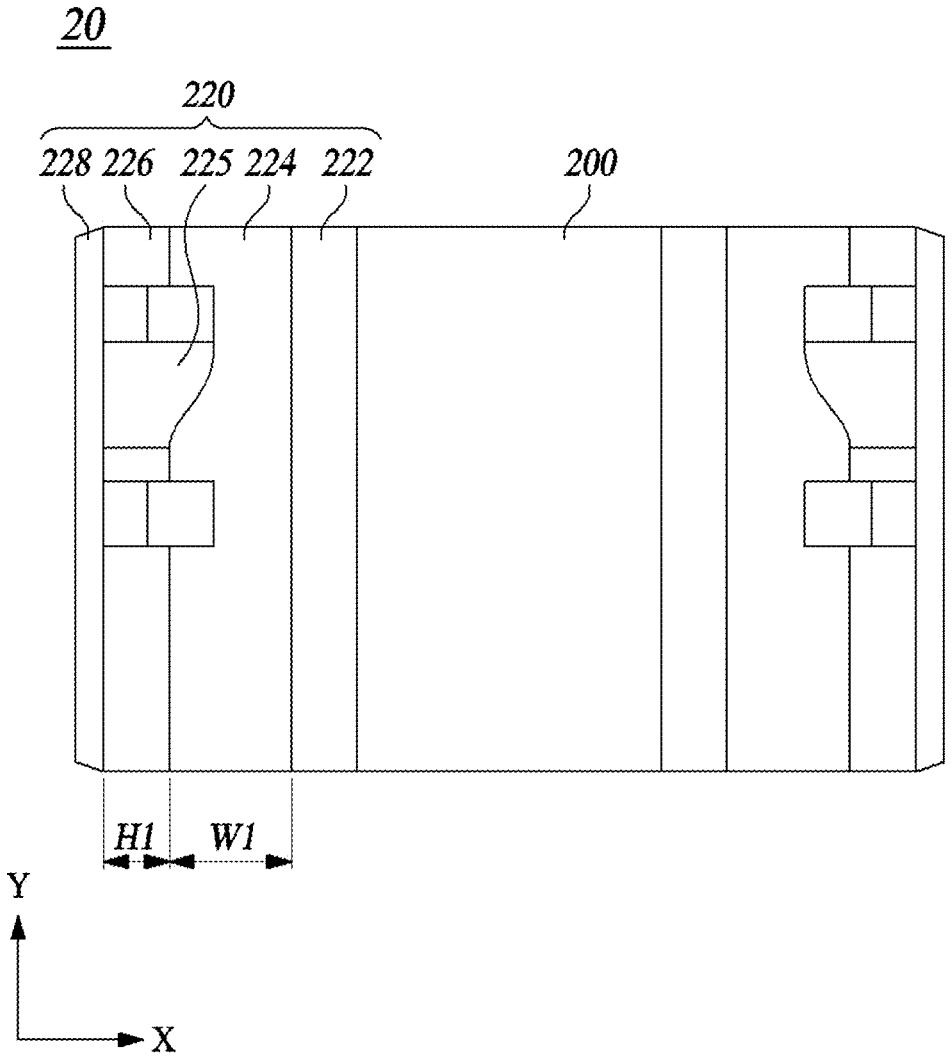
FIG. 2 is a development view of a first packaging unit of the packaging box according to an embodiment of the present disclosure.

FIG. 2 is a development view of a first packaging unit 20 of the packaging box 1 according to an embodiment of the present disclosure.

Figure 3A:
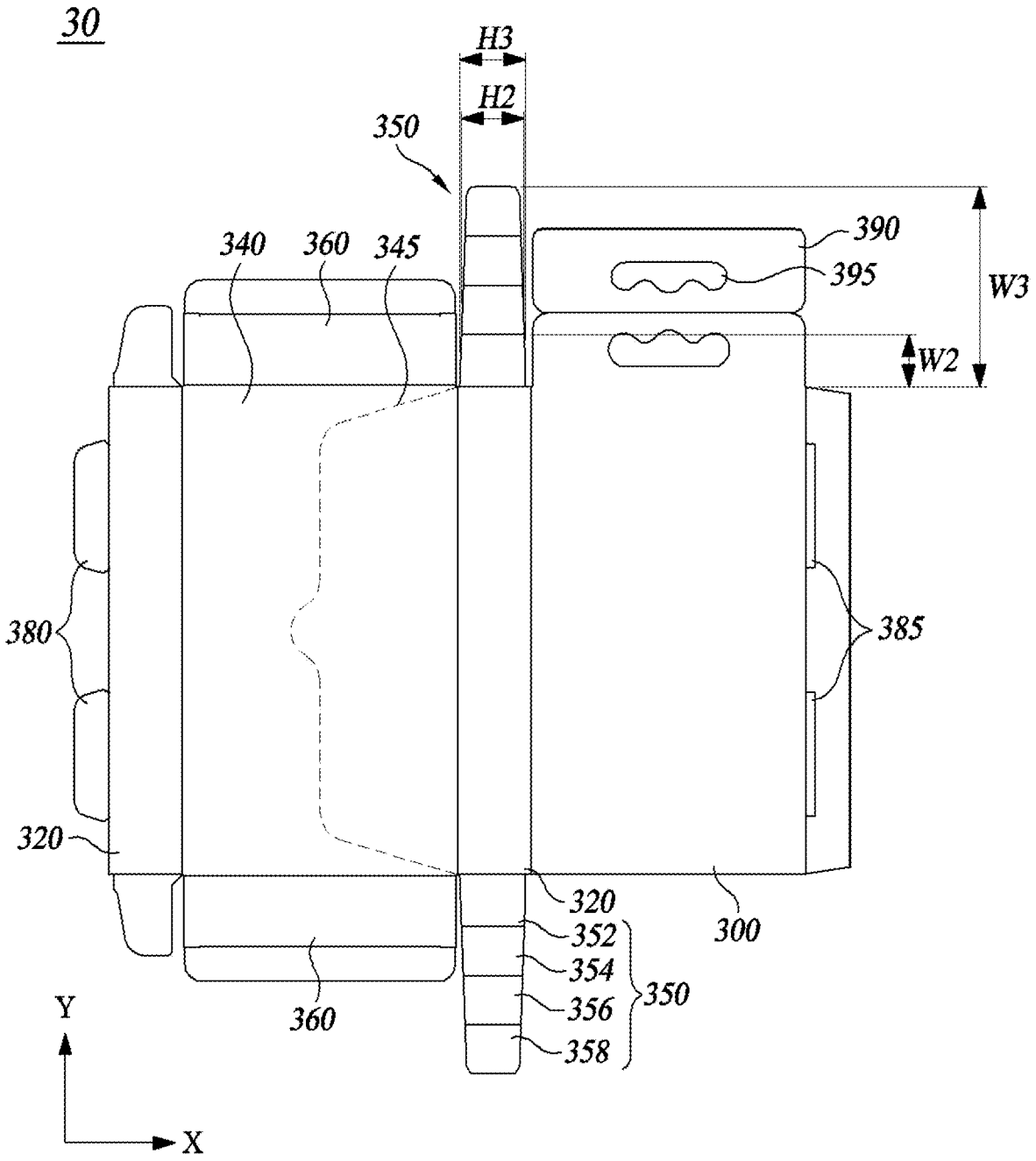
FIG. 3A is a development view of a second packaging unit of the packaging box according to an embodiment of the present disclosure.

FIG. 3A is a development view of a second packaging unit 30 of the packaging box 1 according to an embodiment of the present disclosure.

Figure 3B:
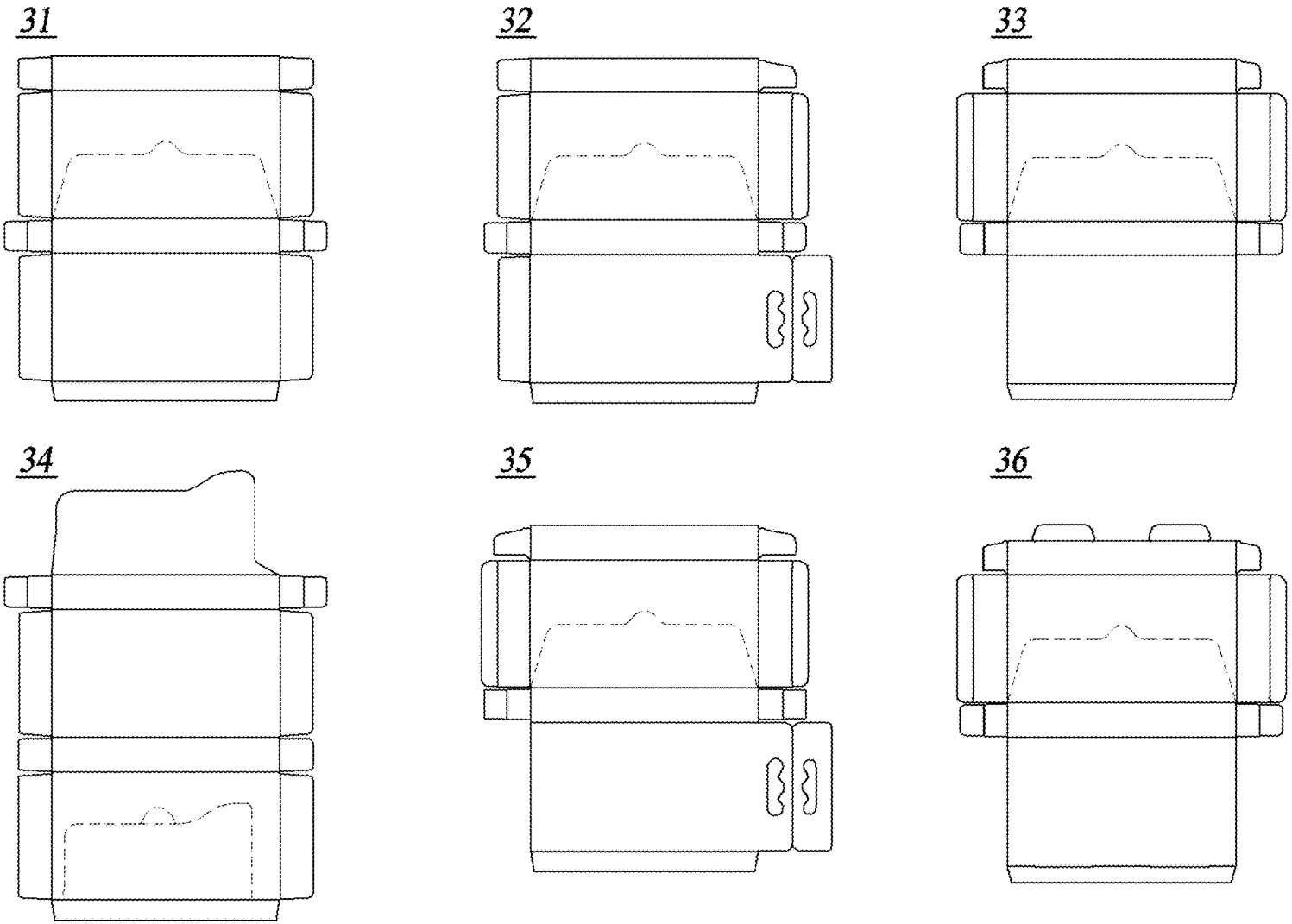
FIG. 3B is a development view of various possible embodiments other than the development view of the second packaging unit illustrated in FIG. 3A.

FIG. 3B is a development view of various possible embodiments other than the development view of the second packaging unit 30 illustrated in FIG. 3A.

Figure 4:
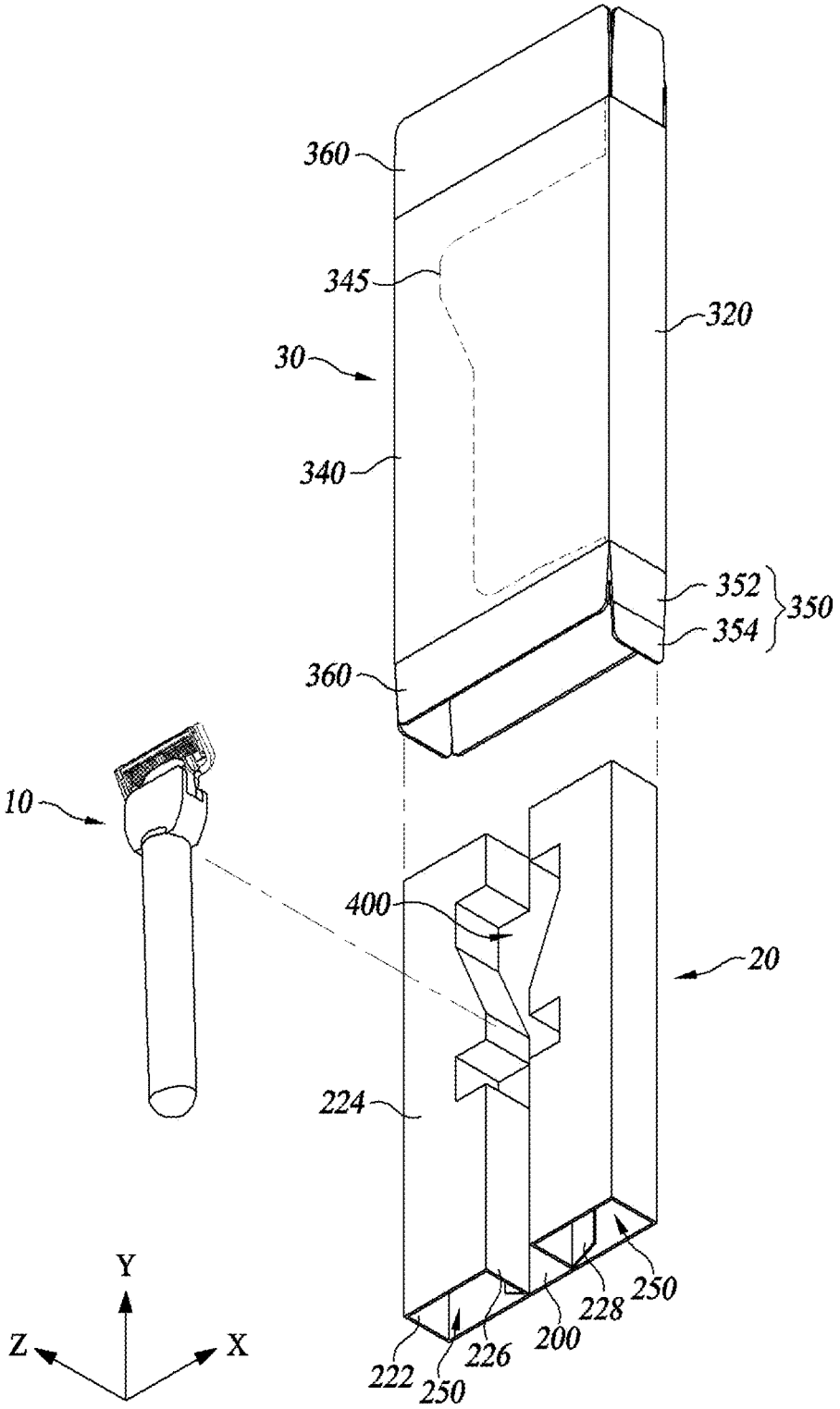
FIG. 4 is an exploded perspective view of the packaging box according to an embodiment of the present disclosure.

FIG. 4 is an exploded perspective view of the packaging box 1 according to an embodiment of the present disclosure.

Figure 5:
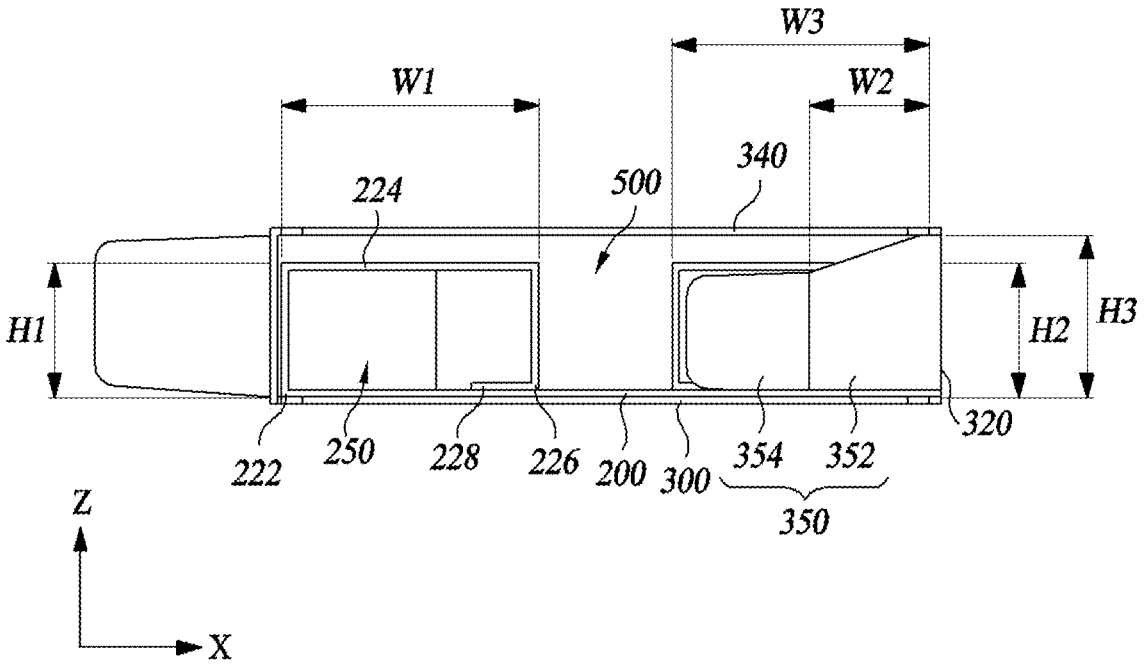
FIG. 5 is a side view of a state before wings of the packaging box enter a coupling opening according to an embodiment of the present disclosure.

FIG. 5 is a side view of a state before wings 350 of the packaging box 1 enter a coupling opening 250 according to an embodiment of the present disclosure.

Figure 6:
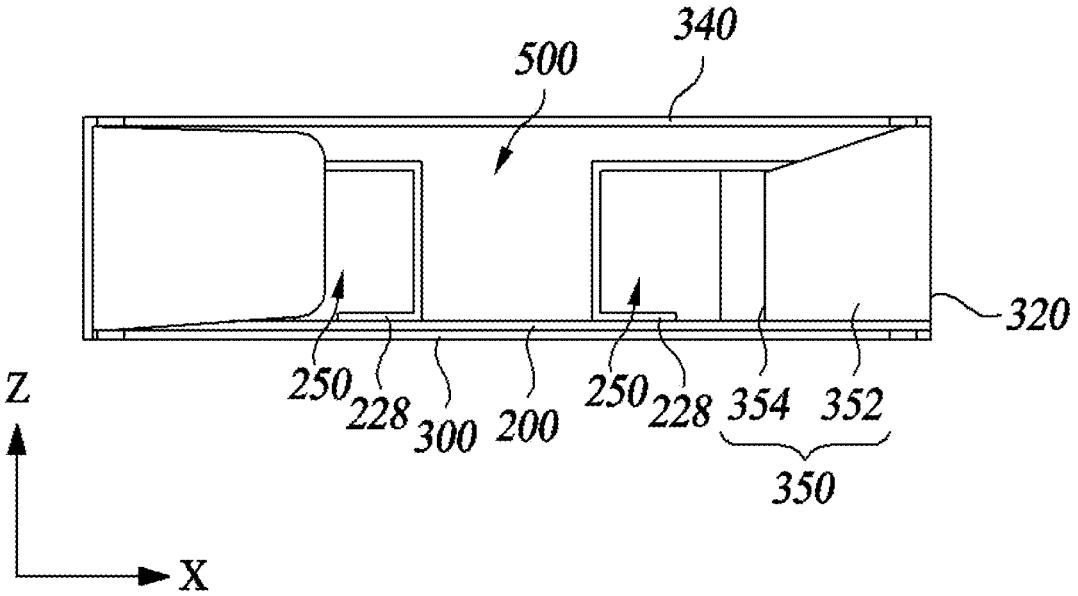
FIG. 6 is a side view of a state after the wings of the packaging box enter the coupling opening according to an embodiment of the present disclosure.

FIG. 6 is a side view of a state after the wings 350 of the packaging box 1 enter the coupling opening 250 according to an embodiment of the present disclosure.

Figure 7:
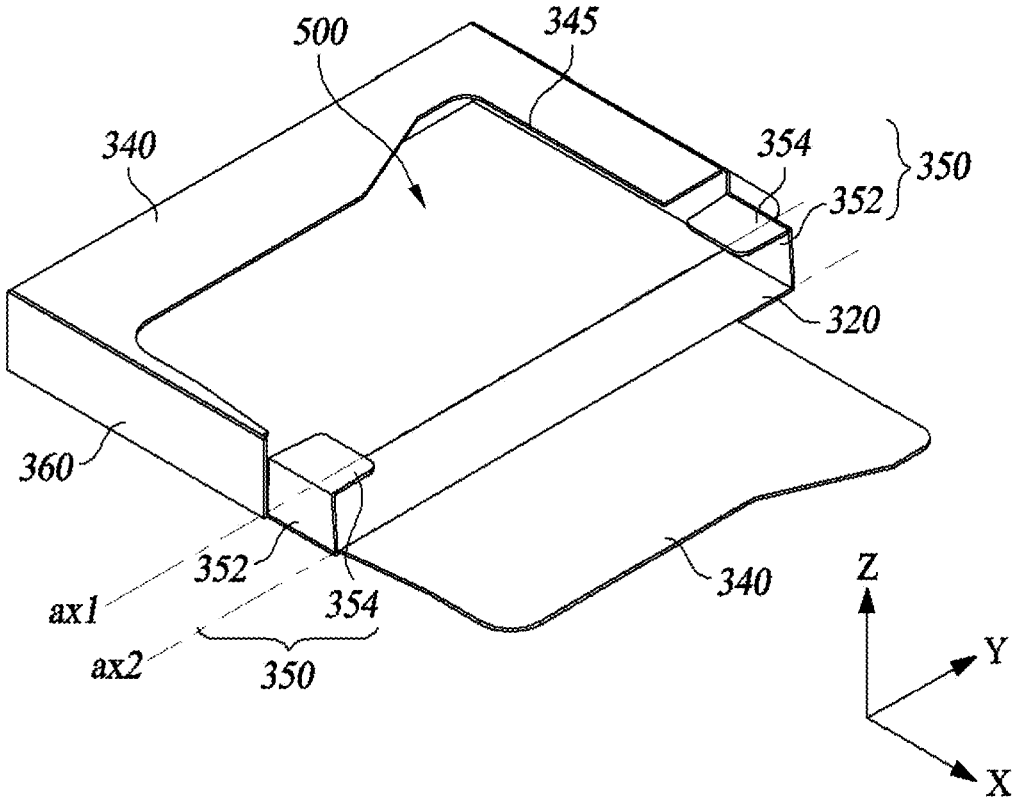
FIG. 7 is a perspective view of the packaging box of FIG. 1 with the first packaging unit omitted.

FIG. 7 is a perspective view of the packaging box 1 of FIG. 1 with the first packaging unit 20 omitted.

Figure 8:
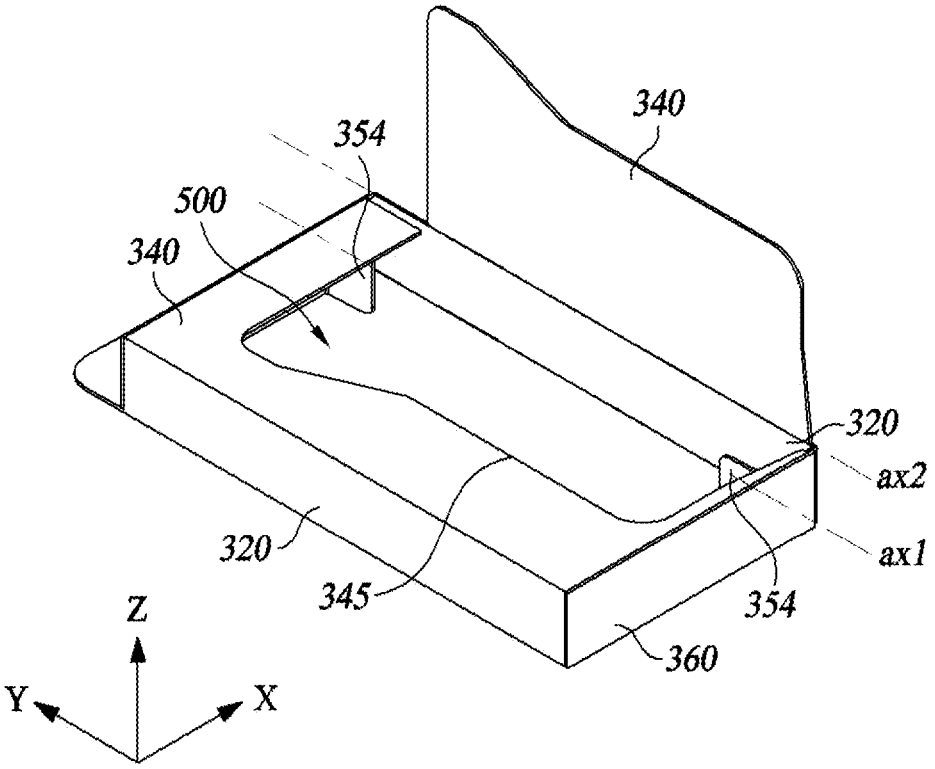
FIG. 8 is a perspective view of an example in which at least a portion of an upper wall of the packaging box pivots about a second pivot axis according to an embodiment of the present disclosure.

FIG. 8 is a perspective view of an example in which at least a portion of a second upper wall 340 of the packaging box 1 pivots about a second pivot axis ax2 according to an embodiment of the present disclosure.

Referring to FIGS. 1 to 8, the packaging box 1 according to an embodiment of the present disclosure may include the first packaging unit 20 and the second packaging unit 30.

Referring to FIG. 1, the first packaging unit 20 may correspond to inner packaging of the packaging box 1 and may accommodate a product, for example, a razor assembly 10. The second packaging unit 30 may correspond to outer packaging of the packaging box 1 and may at least partially accommodate the first packaging unit 20, which is the inner packaging.

In the state before opening, the second packaging unit 30 may accommodate the entire first packaging unit 20. A user may expose at least a portion of the first packaging unit 20 from the second packaging unit through an opening operation, and thus a packaged product may be taken out from the first packaging unit 20.

The first packaging unit 20 and the second packaging unit 30 are preferably made of a bendable sheet of an eco-friendly material, for example, paper, but are not necessarily limited thereto. For example, the first packaging unit 20 may be made of plastic and the second packaging unit 30 may be made of paper, or vice versa.

When the first packaging unit 20 and the second packaging unit 30 are preferably made of sheets of the same material, for example, paper, the first packaging unit 20 and the second packaging unit 30 may be discarded without separating.

Referring to FIG. 2, which shows the developed state of the first packaging unit 20, the first packaging unit 20 may include a first base portion 200 and at least one fixing portion 220.

The first base portion 200 and the at least one fixing portion 220 may be made of one sheet. For example, as shown in FIG. 2, the first base portion 200 may be formed in the center of one sheet, and a pair of fixing portions 220 may be developed on both sides of one sheet.

However, the first base portion 200 and the at least one fixing portion 220 do not necessarily have to be made of one sheet, and each may be manufactured separately and the fixing portion 220 may be coupled or adhered to the first base portion 200.

Each of the at least one fixing portion 220 includes all or part of an outer wall 222, a first upper wall 224, an inner wall 226, a fixing wall 228, and a cutout portion 225.

When the at least one fixing portion 220 includes the pair of fixing portions 220, the outer wall 222, the inner wall 226, the fixing wall 228, and the cutout portion 225 may each be formed as a pair.

Referring to FIGS. 4 to 6 showing the bent state of the first packaging unit 20, the outer wall 222 is bent from the first base portion 200 to have a predetermined height with respect to the first base portion 200.

For example, the predetermined height is preferably equal to or greater than a vertical height with respect to the first base portion 200 from one end of the razor assembly 10 in a height direction in a state where the razor assembly 10 is accommodated in the first packaging unit 20.

Herein, the height direction is the height direction of the packaging box 1 and may be the direction in which the razor assembly 10 is accommodated in the first packaging unit 20. For example, the height direction may be parallel to the Z axis in FIGS. 4 to 6, but is not necessarily limited thereto. In addition, the extension direction of the outer wall 222 and the first base portion 200 are configured to be perpendicular, but are not necessarily limited thereto.

The first upper wall 224 is configured to extend from one end of the outer wall 222 in a direction different from the direction in which the outer wall 222 extends.

The first upper wall 224 is configured to extend in a direction parallel to the first base portion 200, but is not necessarily limited thereto. In the development view of FIG. 2, a width W1 in a longitudinal direction of the first upper wall 224 may be a width in the longitudinal direction of at least one coupling opening 250, which will be described later in FIGS. 4 to 6. Herein, the longitudinal direction is the width direction of the packaging box 1 and may be a direction perpendicular to the direction in which the first packaging unit 20 is accommodated in the second packaging unit 30 and the height direction. For example, the longitudinal direction may be parallel to the X-axis in FIGS. 4 to 6, but is not necessarily limited thereto.

The inner wall 226 extends from one end of the first upper wall 224 toward the first base portion 200 and is configured to contact the first base portion 200.

In FIGS. 4 to 6, the extension direction of the inner wall 226 is parallel to the extension direction of the outer wall 222 and is configured to be perpendicular to the first base portion 200, but is not necessarily limited thereto. In the development view of FIG. 2, a longitudinal width H1 of the inner wall 226 may be the height of the at least one coupling opening 250, which will be described later.

In addition, the height of the inner wall 226 and the height of the outer wall 222 may be the same, but are not necessarily limited thereto.

The fixing wall 228 extends from one end of the inner wall 226 in a direction different from the extension direction of the inner wall 226 and is configured to be fixed to the first base portion 200.

For example, the fixing wall 228 may be adhered to the first base portion 200. In this connection, for fixation to the first base portion 200, the fixing wall 228 may be configured to extend from the inner wall 226 in a direction parallel to the first base portion 200 and contact the first base portion 200, but is not necessarily limited thereto.

In FIGS. 4 to 6, the fixing wall 228 is illustrated extending from one end of the inner wall 226 in a direction toward the inside of the at least one coupling opening 250, but is not necessarily limited thereto. The fixing wall 228 may also extend from one end of the inner wall 226 in a direction toward the outside of the at least one coupling opening 250.

In addition, the fixing wall 228 may be configured to penetrate the first base portion 200 for fixation to the first base portion 200. In this connection, at least a portion of the fixing wall 228 penetrating the first base portion 200 may be configured to contact a lower surface of the first base portion 200 in the height direction, but is not necessarily limited thereto.

Each of the at least one fixing portion 220 does not necessarily include the fixing wall 228. For example, an inner insertion portion (not shown) protruding from one end of the inner wall 226 without the fixing wall 228 may also be inserted into and fixed to a base groove (not shown) formed in the first base portion 200.

The cutout portion 225 is formed over the first upper wall 224 and the inner wall 226 by cutting at least a portion of the first upper wall 224 and the inner wall 226. When the at least one fixing portion 220 includes the pair of fixing portions 220, the space between a pair of inner walls 226 may be widened by a pair of cutout portions 225.

In addition, in the development view, the cutout portion 225 preferably has a shape corresponding to the product being packaged, and the shape of a first accommodation space 400, which will be described later, may be determined by the cutout portion 225, but is not necessarily limited thereto. For example, the shape of the first accommodation space 400, which will be described later, may be changed by changing the shape of the inner wall 226 in the development view.

Referring to FIGS. 4 to 6, the first packaging unit 20 may include the first accommodation space 400 and the at least one coupling opening 250. The first accommodation space 400 and the coupling opening 250 may be formed by bending the developed fixing portion 220.

The first accommodation space 400 is a space that may accommodate a packaged product, for example, the razor assembly 10, and may be configured to have a shape corresponding to the razor assembly 10, but is not necessarily limited thereto.

When the at least one fixing portion 220 includes the pair of fixing portions 220, the first accommodation space 400 may be formed between the pair of inner walls 226, and may include a space formed by cutting at least a portion of each of the pair of first upper walls 224 and at least a portion of each of the pair of inner walls 226.

The at least one coupling opening 250 is open in a lateral direction perpendicular to the longitudinal direction on at least one side of the first accommodation space 400 in the longitudinal direction. Herein, the lateral direction refers to a length direction of the packaging box 1, and may be a direction perpendicular to the direction and height direction in which the first packaging unit 20 is accommodated in the second packaging unit 30. For example, the lateral direction may be parallel to the Y-axis in FIG. 4, but is not necessarily limited thereto.

In FIGS. 1 and 4, the longitudinal length of the packaging box 1 is illustrated to be less than the lateral length, but an embodiment of the present disclosure is not limited thereto. Depending on the shape of the packaged product or the shape of the packaging box, the longitudinal length of the packaging box 1 may be greater than or equal to the lateral length.

The at least one coupling opening 250 may be, for example, a space formed by at least a portion of the first base portion 200, the outer wall 222, the first upper wall 224, the inner wall 226, and the fixing wall 228. When the at least one fixing portion 220 includes the pair of fixing portions 220, the at least one coupling opening 250 may include a pair of coupling openings 250.

The wings 350 of the second packaging unit 30, which will be described later, may be inserted into the first packaging unit 20 through the at least one coupling opening 250.

Referring to FIG. 3A, which illustrates the developed state of the second packaging unit 30, the second packaging unit 30 includes all or part of a second base portion 300 at least one longitudinal side wall 320, a second upper wall 340, at least one lateral side wall 360, a hook portion 390, and at least one wing 350.

The second base portion 300, the at least one longitudinal side wall 320, the at least one lateral side wall 360, the second upper wall 340, and the at least one wing 350 may be made of one sheet.

In FIG. 3A, the second base portion 300 is formed on one side of one sheet, the second upper wall 340 is formed on the other side, and a pair of longitudinal side walls 320 and a pair of lateral side walls 360 are formed along the circumference of the second upper wall 340, without being necessarily limited thereto.

For example, as long as the second packaging unit 30 as illustrated in FIGS. 4 to 7 may be formed, various embodiments of the second packaging unit 31, 32, 33, 34, 35, or 36 illustrated in FIG. 3B may be possible as development views.

For example, the location of the cutout portion 225 and similar configurations to those described later, such as the presence and location of extension portions extending from one end of the lateral side wall 360 and/or the longitudinal side wall 320, the presence of an insertion portion and an insertion hole and the presence of a hook portion 390 and a groove may be adjusted in various ways to suit the purpose of the packaging box 1.

In order for the second packaging unit 30 to accommodate the first packaging unit 20, the longitudinal width of the second base portion 300 is preferably configured to be equal to or greater than the longitudinal width of the first base portion 200.

The hook portion 390 may extend from at least one side portion of the second base portion 300 in a lateral direction. In this connection, when viewed from the upper portion in the height direction, the hook portion 390 may protrude laterally with respect to the at least one longitudinal side wall 320.

A user may easily hold the packaging box 1 by the hook portion 390. When a hook groove 395 penetrating the hook portion 390 is formed in at least a portion of the hook portion 390, the hook groove 395 may be used to display and store the packaging box 1.

At least one longitudinal insertion portion 380 may be formed, for example, extending from one end of one longitudinal side wall 320. In this connection, the at least one longitudinal insertion portion 380 may be inserted into at least one longitudinal insertion hole 385 formed on one longitudinal side of the second base portion 300 or the second upper wall 340. Accordingly, the second packaging unit 30 may be maintained so that the at least one longitudinal side wall 320 has a predetermined height with respect to the second base portion 300 without using a separate adhesive.

However, it is not necessarily limited thereto, and at least one longitudinal side wall 320 may be configured to be adhered to the second base portion 300 or the second upper wall 340. The at least one wing 350 may extend from at least one end of each of the at least one longitudinal side wall 320 in a lateral direction. The at least one wing 350 may be accommodated inside the first packaging unit 20 through the coupling opening 250 of the first packaging unit 20.

Referring to FIGS. 4 to 8, which illustrate the bent state of the second packaging unit 30, the second packaging unit 30 may include a second accommodation space 500. The second accommodation space 500 may be formed by bending the developed second packaging unit 30.

The second accommodation space 500 is configured to accommodate the first packaging unit 20. For example, the second accommodation space 500 is configured to be open in at least one of the lateral, longitudinal, and height directions.

In FIG. 4, the first packaging unit 20 is illustrated to be accommodated in the second packaging unit 30 by entering the second accommodation space 500 from one lateral side of the second packaging unit 30. However, as long as the first packaging unit 20 may be accommodated in the second accommodation space 500, the accommodation method of the first packaging unit 20 is not necessarily limited thereto.

When the first packaging unit 20 is accommodated in the second packaging unit 30 by entering the second accommodation space 500, there is no need to use a separate adhesive for fixing the first packaging unit 20 and the second packaging unit 30. Accordingly, it is possible to provide an eco-friendly packaging box 1.

The at least one longitudinal side wall 320 extends from the second base portion 300 and is configured to have a predetermined height with respect to the second base portion 300 on at least one side portion of the second base portion 300 in the longitudinal direction. In addition, the at least one longitudinal side wall 320 may include the pair of longitudinal side walls 320. In this connection, the pair of longitudinal side walls 320 may have a predetermined height with respect to the second base portion 300 at both longitudinal sides of the second base portion 300.

The predetermined height is preferably configured to be equal to or greater than a height direction length of the first packaging unit 20 so that the second packaging unit 30 may accommodate the first packaging unit 20. The extension direction of the at least one longitudinal side wall 320 and the second base portion 300 are configured to be perpendicular to each other, but are not necessarily limited thereto.

The second upper wall 340 is configured to at least partially cover an upper portion of the first accommodation space 400. The second upper wall 340 may extend from the at least one longitudinal side wall 320 or the at least one lateral side wall 360, which will be described later, in a direction different from the direction in which the longitudinal side wall 320 or the lateral side wall 360 extends.

The second upper wall 340 is configured to extend in a direction parallel to the second base portion 300, but is not necessarily limited thereto.

The at least one lateral side wall 360 is configured to extend from at least one lateral side of the second upper wall 340 or the second base portion 300 in a direction different from the extension direction of the second upper wall 340 or the second base portion 300, for example, in a direction parallel to the height direction.

The height of the at least one lateral side wall 360 is preferably configured to be equal to or greater than the height direction length of the first packaging unit 20 so that the second packaging unit 30 may accommodate the first packaging unit 20. In FIGS. 4 to 8, the extension direction of the at least one lateral side wall 360 and the second base portion 300 are configured to be perpendicular to each other, but is not necessarily limited thereto.

When the first packaging unit 20 is accommodated in the second packaging unit 30, and more specifically in the second accommodation space 500, which will be described later, a movement of the first packaging unit 20 to at least one side in the lateral direction may be limited by the at least one lateral side wall 360.

In addition, the at least one longitudinal side wall 320 may include the pair of longitudinal side walls 320, and in this connection, the at least one lateral side wall 360 may include the pair of lateral side walls 360.

Hereinafter, a state in which the first packaging unit 20 accommodated in the second accommodation space 500 is not moved in the longitudinal direction will be defined and described as an in-position state, and the state in which the pivoting about a first pivot axis ax1 of the at least one wing 350 is completed and movement in the longitudinal direction of the first packaging unit 20 is completed will be defined and described as an opened state.

Referring to FIGS. 5 to 8, at least a portion of the at least one wing 350 is configured to enter at least one side of the coupling opening 250 in the lateral direction when in the in-position state. In this connection, the at least one wing 350 may pivot about the first pivot axis ax1 parallel to the lateral direction.

Herein, the first pivot axis ax1 may be formed at a boundary point between the second base portion 300 and the longitudinal side wall 320 from which the at least one wing 350 extends.

In addition, when the at least one wing 350 pivots about the first pivot axis ax1, the first packaging unit 20 is configured to be moved in the longitudinal direction. Accordingly, when opening packaging, a user may pivot the at least one wing 350 of the second packaging unit 30 and thus move the first packaging unit 20 in the longitudinal direction. Accordingly, at least a portion of the first packaging unit 20 may be taken out from the second packaging unit 30 without the need to separately take out the first packaging unit 20 by hand. Through this convenient opening method, the user may easily take out the product accommodated in the first packaging unit 20.

At least a portion of the second upper wall 340 may pivot about the second pivot axis ax2 parallel to the lateral direction. A perforated portion 345 may be formed on one surface of the second upper wall 340 to separate at least a portion of the second upper wall 340 from the remaining portion.

It may be understood that a user may begin opening the packaging box 1 by separating at least a portion of the second upper wall 340 from the remaining portion through perforation. In addition, by recognizing the state in which the perforated portion 345 is not perforated, the user may recognize that the packaging box 1 is a new product that has not been opened.

In this connection, the second pivot axis ax2 may be located above the first pivot axis ax1 in the in-position state, and the pivoting about the second pivot axis ax2 of at least a portion of the second upper wall 340 may occur before the pivoting about the first pivot axis ax1 of the longitudinal side wall 320 extending in the height direction from one end of the second upper wall 340.

For example, when the pivot about at least a portion of the second pivot axis ax2 of the second upper wall 340 exceeds a preset range, the longitudinal side wall 320 connected to the second upper wall 340 may pivot about the first pivot axis ax1.

In this connection, the at least one wing 350 extending from the longitudinal side wall 320 may also start the pivoting about the first pivot axis ax1 simultaneously. Accordingly, the pivoting about the second pivot axis ax2 of at least a portion of the second upper wall 340 occurs before the pivoting about the first pivot axis ax1 of the at least one wing 350. Herein, the preset range may be, for example, about 90°, but is not necessarily limited thereto.

However, it is not necessary for the longitudinal side wall 320 to pivot about the first pivot axis ax1 only when the pivot of at least a portion of the second upper wall 340 about the second pivot axis ax2 exceeds a preset range. Depending on the direction of the force applied to the packaging box 1 by a user in the process of perforation, in the process of pivoting at least a portion of the second upper wall 340 about the second pivot axis ax2, the longitudinal side wall 320 may be able to pivot about the first pivot axis ax1.

In addition, as the longitudinal side wall 320 pivots about the first pivot axis ax1, the second pivot axis ax2 may rotate about the first pivot axis ax1 and its position may be moved.

After separating at least a portion of the second upper wall 340, a user may pivot the second upper wall 340 about the second pivot axis ax2 to pivot the at least one wing 350 about the first pivot axis ax1. As a result, it is possible to induce movement of the first packaging unit 20 in the longitudinal direction through a more intuitive opening method.

In addition, when viewed from the upper portion, the first accommodation space 400 is at least partially covered by the second packaging unit 30 before the pivoting about the first pivot axis ax1 of the at least one wing 350 begins, and in the opened state, at least 50%, and preferably 75% or more, of the total cross-sectional area may be exposed.

A user may gradually identify the identity of the product accommodated in the first accommodation space 400 depending on the degree of opening of the packaging box 1, which may give the user an anticipation of unboxing. In addition, the packaging box 1 in an opened state may be widely utilized for promotional events and exhibitions of the products being accommodated.

Hereinafter, the at least one wing 350 will be described in more detail.

Referring to FIG. 3A, the at least one wing 350 may extend from at least one end of one longitudinal side wall 320 in the lateral direction. For example, referring to FIGS. 4 to 8, the at least one wing 350 may include a pair of wings 350, and the pair of wings 350 may each extend from both side portions in the lateral direction of any one of the pair of longitudinal side walls 320.

However, it is not necessarily limited thereto, and the at least one wing 350 may be one wing extending from one lateral side portion of any one of the longitudinal side walls 320.

Referring to FIG. 5, the total length W3 to which each of the at least one wing 350 extends may be equal to or less than a longitudinal width W1 of each of the at least one coupling opening 250. This is to allow at least a portion of each of the at least one wing 350 to smoothly enter one side of the at least one coupling opening 250 in the lateral direction, but is not necessarily limited thereto.

Referring to FIG. 3A, each of the at least one wing 350 may include all or part of a first extension portion 352, a second extension portion 354, a third extension portion 356, and a fourth extension portion 358.

When the at least one wing 350 includes the pair of wings 350, the first extension portion 352, the second extension portion 354, the third extension portion 356, and the fourth extension portion 358 may each be formed as a pair. \Hereinafter, each of the extensions 352, 354, 356, and 358 and the components related thereto will be described by assuming them to be singular. However, it is obvious that the following description may be equally applied even when each of the extensions 352, 354, 356, and 358 and their related components are each formed as a pair.

Referring to FIGS. 5 to 8, the first extension portion 352 may extend in the longitudinal direction from the longitudinal side wall 320 in an in-position state.

The height of the side adjacent to the longitudinal side wall 320 of the first extension portion 352 may be the same as the height of the longitudinal side wall 320, but is not necessarily limited thereto. The height of the side adjacent to the longitudinal side wall 320 of the first extension portion 352 may be less than the height of the longitudinal side wall 320.

Referring to FIG. 5, in the development view of FIG. 3A, the first extension portion 352 may be configured such that a longitudinal length H3 of the side adjacent to the longitudinal side wall 320 is greater than the longitudinal length of the side spaced apart from the longitudinal side wall 320. In FIGS. 4 to 6, the first extension portion 352 may be configured such that a height H3 of the side adjacent to the longitudinal side wall 320 is greater than the height of the side spaced apart from the longitudinal side wall 320.

However, it is not necessarily limited thereto, and the aforementioned two longitudinal lengths and two heights of the first extension portion 352 may be configured to be equal to each other.

Referring to FIGS. 5 to 8, the second extension portion 354 may extend in the lateral direction from one end of the first extension portion 352 in an in-position state. However, as long as the second extension portion 354 is configured to enter one lateral side of the coupling opening 250, the extension direction of the second extension portion 354 is not necessarily limited thereto.

Referring to FIG. 5, in the development view of FIG. 3A, a longitudinal length H2 of the side of the second extension portion 354 adjacent to the first extension portion 352 is the same as the longitudinal length of one end of the first extension portion 352. In FIGS. 4 to 6, the second extension portion 354 may be configured such that a height H2 of the side adjacent to the first extension portion 352 is the same as the height of one end of the first extension portion 352.

However, it is not necessarily limited thereto, and in the development view of FIG. 3A, the longitudinal length H2 of the side of the second extension portion 354 adjacent to the first extension portion 352 may be less than the longitudinal length of one end of the first extension portion 352. In this connection, in FIGS. 4 to 6, the second extension portion 354 may be configured so that the height of the side adjacent to the first extension portion 352 is less than the height of one end of the first extension portion 352.

Meanwhile, the maximum height of the second extension portion 354 in an in-position state, for example, the height H2 of the side of the second extension portion 354 adjacent to the first extension portion 352, is preferably less than the height of the coupling opening 250 at a position corresponding to the boundary between the first extension portion 352 and the second extension portion 354. As a result, the second extension portion 354 may enter one side of the coupling opening 250 in the lateral direction.

The third extension portion 356 is configured to extend in the longitudinal direction from one end of the second extension portion 354 in an in-position state. However, as long as the extension direction of the third extension portion 356 is toward the outer wall 222 in an in-position state, the extension direction of the third extension portion 356 is not necessarily limited thereto.

Referring again to FIG. 3A, in the development view, the third extension portion 356 may extend in the lateral direction from one end of the second extension portion 354.

When the wing 350 includes the third extension portion 356, not only may the wing 350 not be easily separated from the coupling opening 250, but also when the wing 350 pivots about the first pivot axis ax1, the pressing force on one side surface of the first upper wall 224 and/or the outer wall 222 of the wing 350 may become greater. This will be described in detail in the description of FIG. 9.

The fourth extension portion 358 is configured to extend in the lateral direction from one end of the third extension portion 356 in an in-position state. However, as long as the extension direction of the fourth extension portion 358 is toward the first extension portion 352 in an in-position state, the extension direction of the fourth extension portion 358 is not necessarily limited thereto.

Referring again to FIG. 3A, in the development view, the fourth extension portion 358 may extend in the lateral direction from one end of the third extension portion 356.

When the wing 350 includes the fourth extension portion 358, not only may the wing 350 not be easily separated from the coupling opening 250, but also when the wing 350 pivots about the first pivot axis ax1, the pressing force on one side surface of the first upper wall 224 and/or the outer wall 222 of the wing 350 may become greater. This will be described in detail in the description of FIG. 9.

In FIGS. 4 to 8, although each of the at least one wing 350 is illustrated not including the third extension portion 356 and the fourth extension portion 358, it will be apparent that when these components are included, the aforementioned benefits may be achieved.

Figure 9:
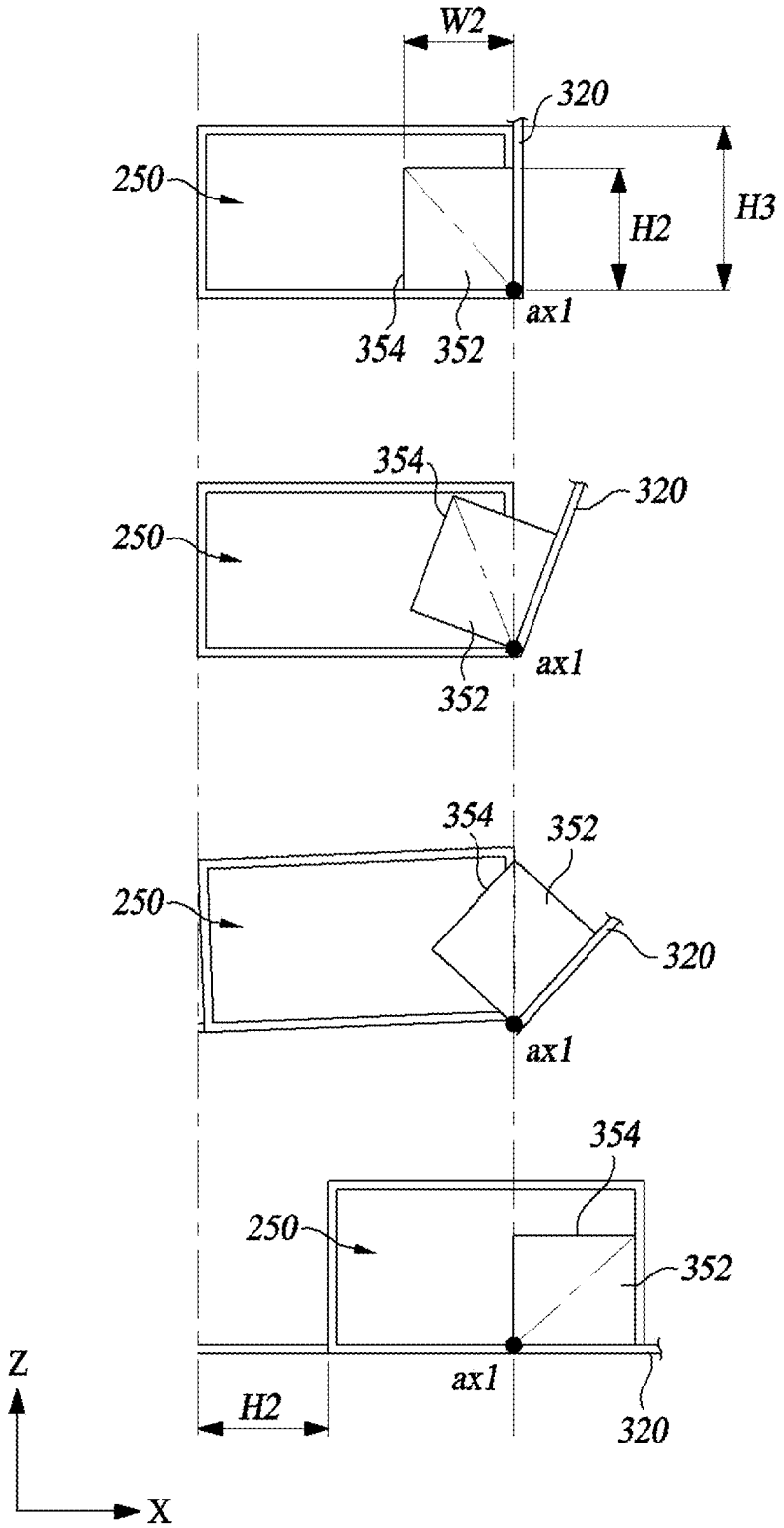
FIG. 9 is a schematic view of a process in which the wings of the packaging box pivot about a first pivot axis from one side in a lateral direction according to an embodiment of the present disclosure.

FIG. 9 is a schematic view of a process in which the wings 350 of the packaging box 1 pivot about the first pivot axis ax1 from one side in a lateral direction according to an embodiment of the present disclosure.

Referring to FIG. 9, the wing 350 may be configured to press one side surface in the longitudinal direction of the coupling opening 250 while the wing 350 pivots about the first pivot axis ax1. As the wing 350 presses the one side surface in the longitudinal direction of the coupling opening 250, the first packaging unit 20 may be moved in the longitudinal direction.

In the process of the wing 350 pivoting about the first pivot axis ax1, the wing 350 may be configured to press one side surface of the coupling opening 250 in the height direction, but is not necessarily limited thereto.

In addition, when viewed from one side in the lateral direction, the coupling opening 250 may be configured to have a cross-sectional shape of a closed loop. In this connection, as the wing 350 presses one side surface in the longitudinal direction and/or one side surface in the height direction of the coupling opening 250, the cross-sectional shape of the closed loop may be deformable.

In FIG. 9, the cross-sectional shape of the coupling opening 250 is shown to be rectangular, and the cross-sectional shape is illustrated as remaining unchanged during the process of pivoting the wing 350 about the first pivot axis ax1. However, as described above, the cross-sectional shape of the closed loop may be deformable.

When the cross-sectional shape of the closed loop changes while the wing 350 pivots about the first pivot axis ax1, a user may feel a smooth pivoting sensation while pivoting the wing 350.

However, depending on the strength of the material of the first packaging unit 20, the cross-sectional shape of the closed loop may not change while the wing 350 pivots about the first pivot axis ax1.

In addition, the distance that the first packaging unit 20 moves in the longitudinal direction from the in-position state to the opened state may be determined by the maximum length in the height direction (for example, H2) of the second extension portion 354 in the in-position state. Accordingly, the longitudinal movement distance of the first packaging unit 20 in the opened state may be easily determined by adjusting the maximum longitudinal width of the second extension portion 354 in the development view of FIG. 3A.

In addition, the longitudinal width of the first extension portion 352 in the in-position state may be equal to an extension length W2 in the lateral direction of the first extension portion 352 in the development view of FIG. 3A, which may be a factor that affects the pivoting feeling felt as a user pivots the wing 350 or the perception of the opening action. For example, as the longitudinal width W2 of the first extension portion 352 is greater, the user may easily open the packaging box through a smooth pivoting feeling, and as the longitudinal width is less, perception of the opening action may be improved.

For smooth pivoting of the wing 350, a gap may be formed in the height direction between the coupling opening 250 and the first extension portion 352 based on the in-position state. To this end, based on the in-position state, the height direction length H3 of the coupling opening 250 may be set to be greater than the height direction length H2 of the first extension portion 352 by a predetermined value or more.

The spirit of the present embodiment is illustratively described hereinabove. It will be appreciated by those skilled in the art to which the present embodiment pertains that various modifications and alterations may be made without departing from the essential characteristics of the present embodiment. Accordingly, the present embodiments are not to limit the spirit of the present embodiment, but are to describe the spirit of the present embodiment. The technical idea of the present embodiment is not limited to these embodiments. The scope of the present embodiment should be interpreted by the following claims, and it should be interpreted that all the spirits equivalent to the following claims fall within the scope of the present embodiment.

What is claimed is:

1. A packaging box, comprising:

a first packaging unit comprising a first accommodation space that is open at an upper portion, the first packaging unit comprising a coupling opening open in a lateral direction perpendicular to a longitudinal direction at least on one side of the longitudinal direction of the first accommodation space; and a second packaging unit comprising a second accommodation space configured to accommodate the first packaging unit, wherein the second packaging unit comprises at least one wing extending from a longitudinal side wall and configured, in an in-position state, to enter one lateral side of the coupling opening, the wing being configured to pivot about a first pivot axis that is parallel to the lateral direction, wherein, during pivoting of the wing about the first pivot axis, the wing presses against at least one side surface of the coupling opening such that the first packaging unit is translated in the longitudinal direction relative to the second packaging unit, and wherein the wing remains in contact with the coupling opening during pivoting so that the longitudinal translation of the first packaging unit occurs while the wing maintains contact with the coupling opening.

2. The packaging box of claim 1, wherein the second packaging unit comprises:

a base portion; and the longitudinal side wall extending from the base portion and configured to have a predetermined height with respect to the base portion at one longitudinal side of the base portion, wherein the wing is configured to extend from one lateral end of the longitudinal side wall.

3. The packaging box of claim 2, wherein the wing in the in-position state comprises:

a first extension portion extending from the longitudinal side wall in the longitudinal direction; and a second extension portion extending in the lateral direction from one end of the first extension portion.

4. The packaging box of claim 3, wherein a direction perpendicular to the longitudinal direction and the lateral direction is defined as a height direction, in the in-position state, and wherein a height direction length of the second extension portion is less than or equal to a height direction length of the coupling opening at a position corresponding to the boundary of the first extension portion and the second extension portion.

5. The packaging box of claim 3, wherein a distance that the first packaging unit moves in the longitudinal direction from the in-position state to an opened state in which the pivoting about the first pivot axis of the wing is completed is determined by the maximum length in a height direction of the second extension portion in the in-position state.

6. The packaging box of claim 1, wherein the wing is configured to press the at least one side surface in the longitudinal direction of the coupling opening in pivoting about the first pivot axis.

7. The packaging box of claim 1, wherein the wing is configured to press the at least one side surface in a height direction of the coupling opening in pivoting about the first pivot axis.

8. The packaging box of claim 1, wherein:

when viewed from one side in the lateral direction, the coupling opening is configured to have a cross-sectional shape of a closed loop; and the cross-sectional shape of the closed loop is deformable in response to the wing pivoting about the first pivot axis.

9. The packaging box of claim 1, wherein:

the second packaging unit comprises an upper wall configured to at least partially cover an upper portion of the first accommodation space when the first packaging unit is accommodated in the second accommodation space; and at least a portion of the upper wall is configured to pivot about a second pivot axis parallel to the lateral direction.

10. The packaging box of claim 9, wherein:

the second pivot axis is located above the first pivot axis in the in-position state; and the pivoting about the second pivot axis of at least a portion of the upper wall occurs before the pivoting about the first pivot axis of the wing.

11. The packaging box of claim 9, wherein:

the second packaging unit further comprises a lateral side wall configured to extend in a direction parallel to a height direction from one lateral side of the upper wall or a base portion opposite to the upper wall in the height direction; and a movement of the first packaging unit to the one lateral side is limited by the lateral side wall.

12. The packaging box of claim 1, wherein a length to which the wing extends is less than a longitudinal width of the coupling opening.

13. The packaging box of claim 1, wherein:

when viewed from the upper portion the first accommodation space is at least partially covered by the second packaging unit before the pivoting about the first pivot axis of the wing begins; and the first accommodation space is exposed to 75% or more of the total cross-sectional area in an opened state in which the pivoting about the first pivot axis of the wing is completed.

14. The packaging box of claim 1, wherein at least one of the second packaging unit and the first packaging unit is made of a bendable sheet of an eco-friendly material.

15. The packaging box of claim 1, wherein the wing comprises a first extension portion and a second extension portion extending from the first extension portion, and wherein, during pivoting of the wing, the first extension portion and the second extension portion are configured to contact the coupling opening.

16. The packaging box of claim 1, wherein the first pivot axis is formed at a boundary between a base portion of the second packaging unit and the longitudinal side wall from which the wing extends.

17. The packaging box of claim 1, wherein the in-position state is a state in which the first packaging unit accommodated in the second accommodation space is not moved in the longitudinal direction.

18. The packaging box of claim 1, wherein the second packaging unit comprises an upper wall configured to at least partially cover an upper portion of the first accommodation space when the first packaging unit is accommodated, and wherein at least a portion of the upper wall is configured to pivot about a second pivot axis parallel to the lateral direction.

* * * * *